US012564272B1

(12) United States Patent
Yang

(10) Patent No.: US 12,564,272 B1
(45) Date of Patent: Mar. 3, 2026

(54) INFLATABLE MATTRESS STRUCTURE WITH OVERLAPPING INDEPENDENT AIR CHAMBERS

(71) Applicant: Formosa Saint Jose Corporation, Taipei (TW)

(72) Inventor: Ming-Shun Yang, Taipei (TW)

(73) Assignee: Formosa Saint Jose Corporation, Taipei (TW)

( * ) Notice: Subject to any disclaimer, the term of this patent is extended or adjusted under 35 U.S.C. 154(b) by 0 days.

(21) Appl. No.: 19/354,540

(22) Filed: Oct. 9, 2025

(51) Int. Cl.
*A47C 27/10* (2006.01)
*A47C 27/08* (2006.01)

(52) U.S. Cl.
CPC ..... *A47C 27/10* (2013.01); *A47C 27/087* (2013.01)

(58) Field of Classification Search
CPC ..... A47C 27/10; A47C 27/087; A47C 27/082; A47C 4/54; A47C 31/105; A47C 21/048; A47C 27/088; A47C 27/084; A47C 27/083; A47C 27/128; A47C 27/18; A47C 21/044; A47C 27/08; A47C 27/001; A47C 27/085; A47C 27/081; A61G 7/1028; A61G 7/05769; A61G 7/1021; A61G 2200/32; A61G 7/05776; A61G 7/1026; A47G 9/1027; A47G 2009/003; B29L 2022/02; B29L 2031/751; A47D 15/001
USPC ... 5/710, 655, 709, 714, 713, 712, 711, 706, 5/655.3, 707, 654, 739
See application file for complete search history.

(56) References Cited

U.S. PATENT DOCUMENTS

| | | | | |
|---|---|---|---|---|
| 5,598,593 | A | 2/1997 | Wolfe | |
| 7,610,642 | B2 * | 11/2009 | Boyd | A47C 27/10 5/710 |
| 10,500,429 | B1 * | 12/2019 | Bagumyan | A63B 6/02 |
| 12,357,101 | B1 | 7/2025 | Yang | |
| 2005/0050637 | A1 | 3/2005 | Graebe | |
| 2011/0083280 | A1 * | 4/2011 | Davis | A47C 27/081 5/712 |

* cited by examiner

*Primary Examiner* — Madison Emanski
(74) *Attorney, Agent, or Firm* — Ying-Ting Chen

(57) ABSTRACT

An inflatable mattress structure having overlapping independent air chambers includes a cover made of a flexible material and including a top cover portion, a bottom cover portion, and a middle cover portion; at least one middle divider arranged inside the cover and having a periphery securely and entirely affixed to the middle cover portion; an enclosed air chamber formed by the cover and divided by the middle divider to form a top enclosed air chamber and a bottom enclosed air chamber overlappingly, isolatedly, and independently arranged with respect to the top enclosed air chamber; at least one first divider disposed inside the top enclosed air chamber having at least two sub-top enclosed air chambers; wherein at least one second divider disposed inside the bottom enclosed air chamber having at least two sub-bottom enclosed air chambers.

19 Claims, 9 Drawing Sheets

INFLATABLE MATTRESS STRUCTURE WITH OVERLAPPING INDEPENDENT AIR CHAMBERS

FIELD OF THE DISCLOSURE

The present invention relates to an inflatable mattress structure, and more particularly to an inflatable mattress structure featuring overlapping, independent air chambers, in which the inflation volumes of the top and bottom air chambers can be adjusted independently.

BACKGROUND OF THE DISCLOSURE

Generally, inflatable pads or mattresses have been widely used in various applications, including household, automotive, and medical purposes. However, although conventional inflatable mattresses are available in many types, they are generally inflated directly through the outer covering, which not only makes them prone to deformation but also renders them unusable if accidental damage occurs.

A further problem with conventional inflatable pads or inflatable mattresses is that when additional height is needed, the common approach is to increase the overall thickness of the mattress directly.

In practical use, this results in significant shaking and instability, causing discomfort to the user and, in some cases, leading to tipping, falling, or displacement of the entire mattress, creating substantial inconvenience and difficulty during use.

Accordingly, designing and manufacturing an inflatable mattress structure with overlapping, independent air chambers that can address the shortcomings of conventional inflatable pads or mattresses has become an important issue for related manufacturing and design industries. Such a structure should offer the following features: simple setup and storage; prevent the entire mattress from becoming arcuate after inflation; provide overlapping layered independent air chambers that allow the upper and lower layers to be inflated separately to adjust softness and hardness and effectively reduce shaking; be washable and air-dryable to avoid dirt or infection, include internally fixed partition pieces that, when inflated, form a wavy surface to improve breathability and heat dissipation; allow for the selection or quick replacement of outer coverings with different appearances or materials; be easy to manufacture; meet various application needs such as automotive, household, hospital, or seat cushion use; and further allow inflatable inner tubes to be separately provided in the upper and lower air chambers to independently adjust the inflation of the upper and lower mattress layers, thereby offering different softness and hardness for each layer while reducing shaking. This remains fully functional even if the outer covering is damaged. Such features make it immediately suitable for a wide range of applications and achieve multi-functional versatility.

All referenced patents, applications, and literature are incorporated herein by reference in their entirety. Furthermore, where a definition or use of a term in a reference, which is incorporated by reference herein, is inconsistent or contrary to the definition of that term provided herein, the definition of that term provided herein applies, and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, the inflatable mattress structure having overlapping independent air chambers may comprise a cover, an enclosed air chamber, at least one middle divider, at least one first divider, and at least one second divider. It is easy to set up and store. The overlapping, layered, independent air chambers, in which the upper and lower layers can be separately adjusted for firmness, effectively and significantly reduce shaking. In this way, it can be rinsed and air-dried for use, preventing dirt or infection. The first and second dividers are fixed inside, allowing the surface of the inflatable mattress structure to form a wavy shape when inflated, which improves breathability and heat dissipation during use. Additionally, the cover is interchangeable for quick replacement with different appearances or materials, as needed or preferred by the application. It is easy to manufacture and can be produced in various sizes of inflatable mattress structures, suitable not only for automotive, household, or hospital use, but also, by choosing different sizes and shapes, the inflatable mattress structure can serve as seat cushions or meet various other application needs. The inflatable inner tubes can be provided in the top and bottom enclosed air chambers to separately adjust the firmness of the upper and lower layers of the mattress, and further reduce shaking. Even if the cover is damaged, full functionality can still be maintained.

In another aspect combinable with the general implementation, the inflatable mattress structure having overlapping independent air chambers may comprise a cover made of flexible material, three-dimensionally enclosed in a sealed manner to form an enclosed air chamber, wherein the cover comprises a top cover portion and a bottom cover portion opposite thereto, and a middle cover portion having a top middle cover edge and a bottom middle cover edge arranged on an opposite side of the top middle cover edge, wherein the top middle cover edge may be affixed with the top cover portion, and the bottom cover edge may be affixed with the bottom cover portion. The inflatable mattress structure may comprise at least one middle divider arranged inside the enclosed air chamber and having a peripheral middle divider edge securely and entirely affixed to the middle cover portion, an enclosed air chamber formed by the cover and divided by the middle divider to form a top enclosed air chamber and a bottom enclosed air chamber overlappingly, isolatedly, and independently arranged with respect to the top enclosed air chamber, at least one first divider disposed inside the top enclosed air chamber and having a first top divider end tightly affixed to the top cover portion and a second top divider end tightly affixed to the middle divider to divide the top enclosed air chamber into at least two sub-top enclosed air chambers, and at least one second divider disposed inside the bottom enclosed air chamber and having a first bottom divider end tightly affixed to the middle divider and a second bottom divider end tightly affixed to the bottom cover portion to divide the bottom enclosed air chamber into at least two sub-bottom enclosed air chambers.

The inflatable mattress structure having overlapping independent air chambers can at least achieve the following multiple special advantageous effects:

1. Easy to set up and store.
2. The structure will not become entirely arcuate after inflation.

3. The features of overlapping layered independent air chambers, with the upper and lower independent chambers capable of separately adjusting the inflation amount to provide different firmness levels for the upper and lower layers.
4. The layered independent chamber structure can effectively and significantly reduce shaking.
5. It can be rinsed and air-dried for use to prevent dirt or infection.
6. The internal fixed dividers create a wavy surface when inflated, enhancing breathability and heat dissipation during use.
7. The structure allows selection or quick replacement of different appearances or materials for the outer cover according to application needs or preferences.
8. The structure is easy to manufacture and capable of producing inflatable mattresses of various sizes.
9. The structure is suitable for use as mattresses in vehicles, households, and hospitals, or as seat cushions, meeting various application needs.
10. The top enclosed air chamber and the bottom enclosed air chamber can respectively be provided with inflatable inner tubes to adjust firmness and reduce shaking independently, and even if the cover is damaged, the full functionality can still be maintained.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features described in the context of a single implementation can also be implemented separately in multiple implementations or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Furthermore, the steps in such example operations, methods, or processes may be performed in a different succession than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to the precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

Figure 1:
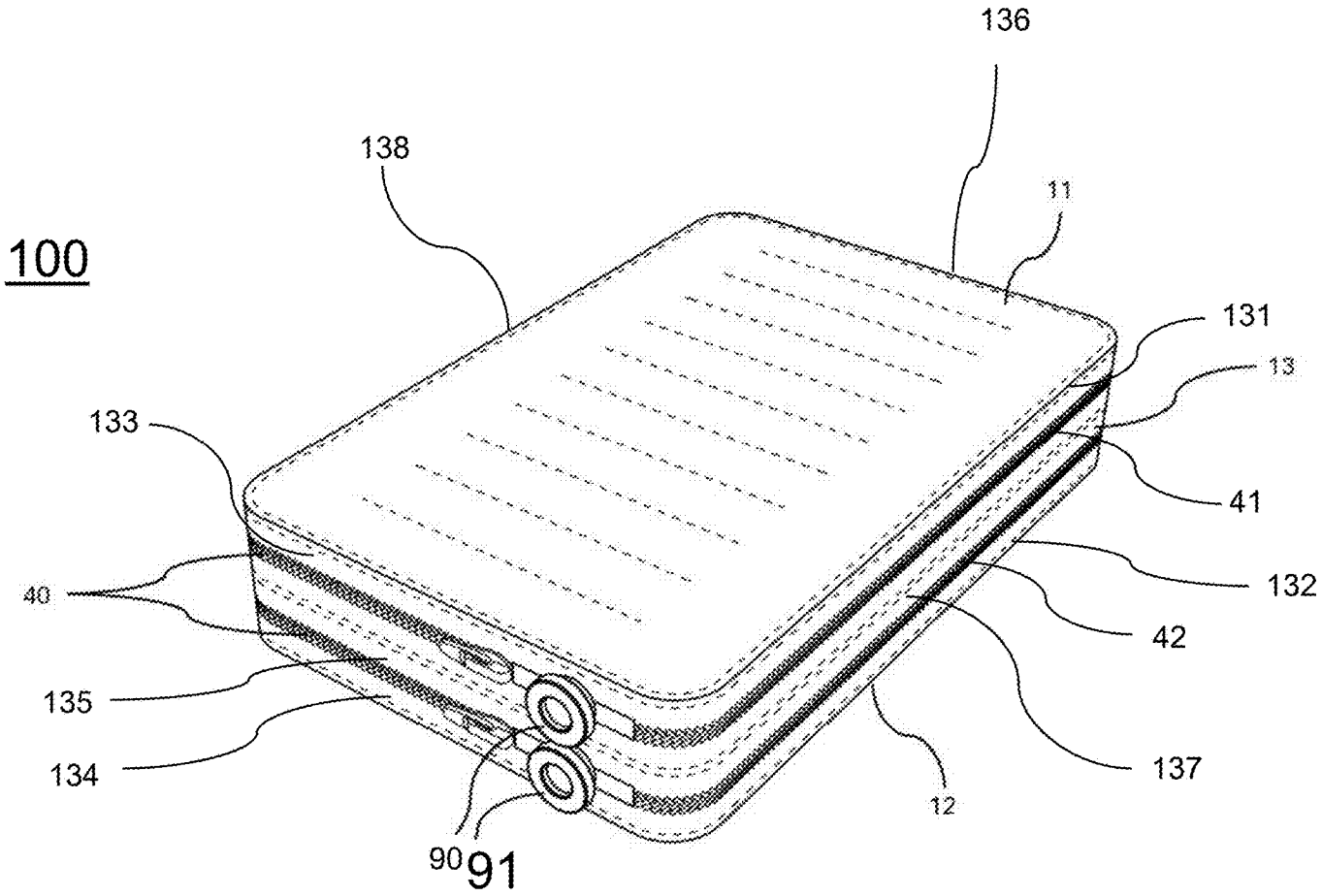
FIG. 1 is a perspective view of an inflatable mattress structure with overlapping independent air chambers according to an aspect of the embodiment.

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more", and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

FIGS. 1-9 generally depict an inflatable mattress structure with overlapping independent air chambers according to an aspect of the embodiments.

Referring to FIGS. 1-6, in some embodiments, the inflatable mattress structure 100 with overlapping independent air chambers can be inflated for use in various scenarios such as automotive, household, medical, and recreational applications. The inflatable mattress structure 100 with overlapping independent air chambers may comprise a cover 10 may be formed as a three-dimensional airtight container to define an enclosed air chamber 20, at least one middle divider 30, at least one first divider 50, and at least one second divider 60. In some embodiments, the at least one middle divider 30 may be configured to divide the enclosed air chamber 20 to form a top enclosed air chamber 21 and a bottom enclosed air chamber 22.

Figure 2:
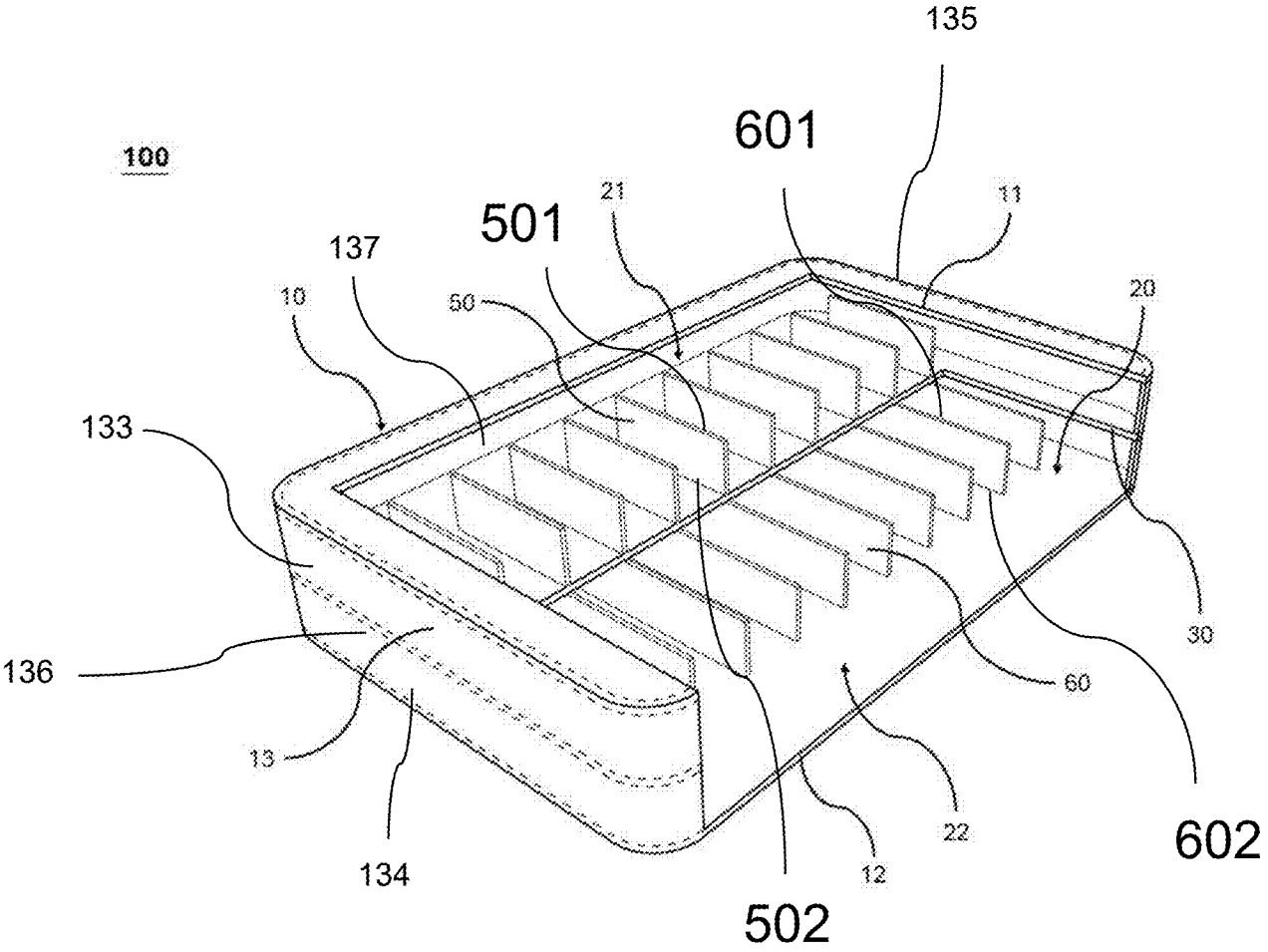
FIG. 2 is an exploded view of the inflatable mattress structure with overlapping independent air chambers according to an aspect of the embodiment.

In some embodiments, as shown in further detail in FIG. 1 and FIG. 2, the cover 10 may be made of flexible materials. In some embodiments, the cover 10 may be formed as a three-dimensional airtight container to define the enclosed air chamber 20. In still some embodiments, the cover 10 may comprise a top cover portion 11 and a bottom cover portion 12 oppositely arranged with respect to the top cover portion 11, wherein the cover 10 may further comprise a middle cover portion 13 integrally extended and formed between the top cover portion 11 and the bottom cover portion 12. In some embodiments, the first top cover portion 11 may be parallel to the second bottom cover portion 12.

In some embodiments, the middle cover portion 13 may comprise a top middle cover edge 131 and a bottom middle cover edge 132 arranged on an opposite side of the top middle cover edge 131, wherein the top middle cover edge 131 may be affixed with the top cover portion 11 through a high-frequency welding, and the bottom cover edge 132 may be affixed with the bottom cover portion 12 through a high-frequency welding. Additionally, the middle divider 30 may be affixed to the middle cover portion 13 using high-frequency welding. It should be noted that, while the cover 10 is made of a plastic material, the high-frequency welding is the preferred method.

In some embodiments, the top middle cover edge 131 may be affixed to the top cover portion 11 by sewing, and the bottom cover edge 132 may be affixed to the bottom cover portion 12 by sewing. In addition, the middle cover portion 13 may be affixed to the middle cover portion 13 through sewing.

It should be noted that, while the cover 10 is made of a fabric material such as fiber cloth, the sewing is the preferred method. The middle divider 30 may be a whole sheet of fabric or in the form of a mesh.

Figure 3:
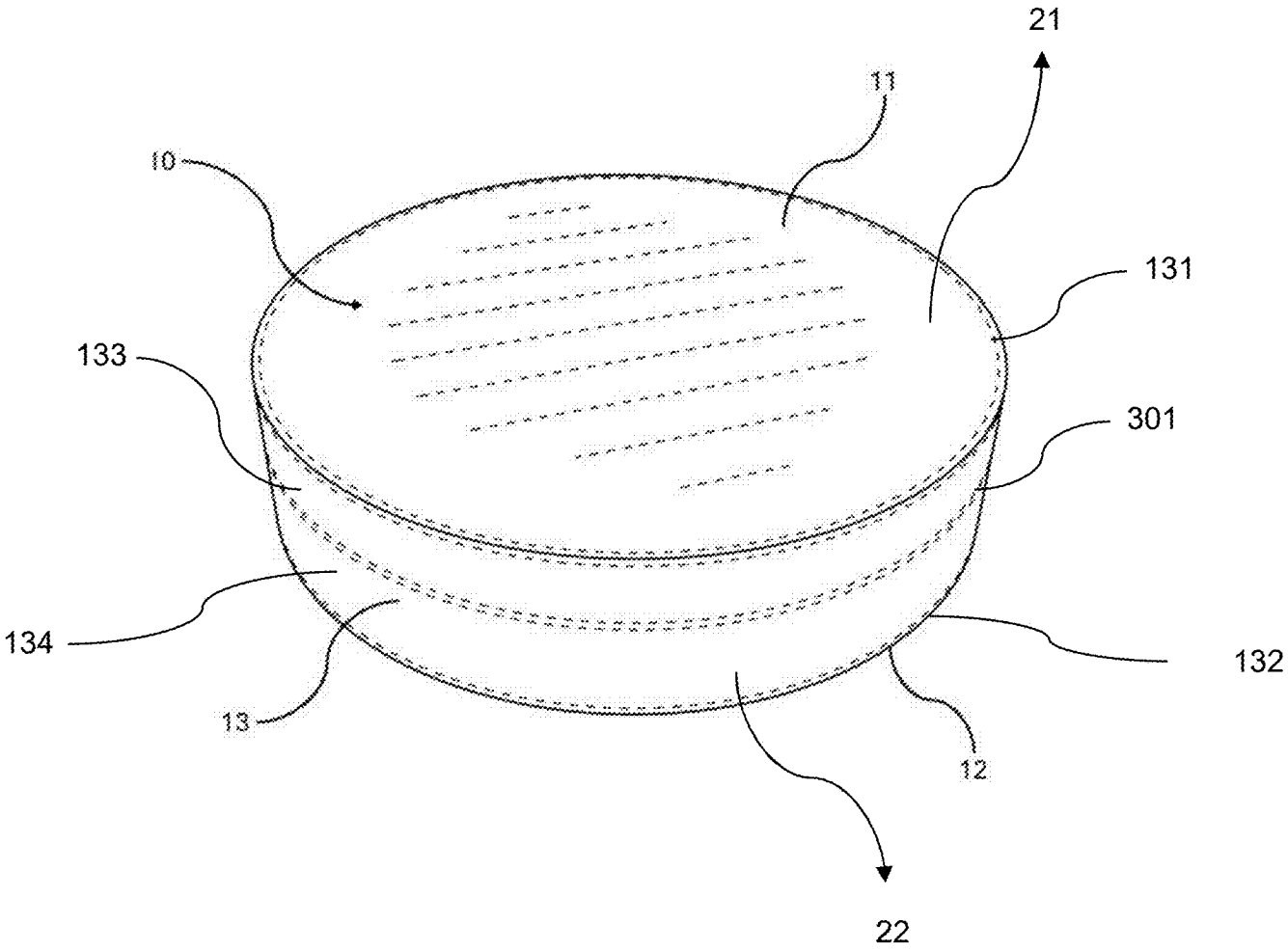
FIG. 3 is a perspective view of the inflatable mattress structure with overlapping independent air chambers according to another aspect of the embodiment.
Figure 4:
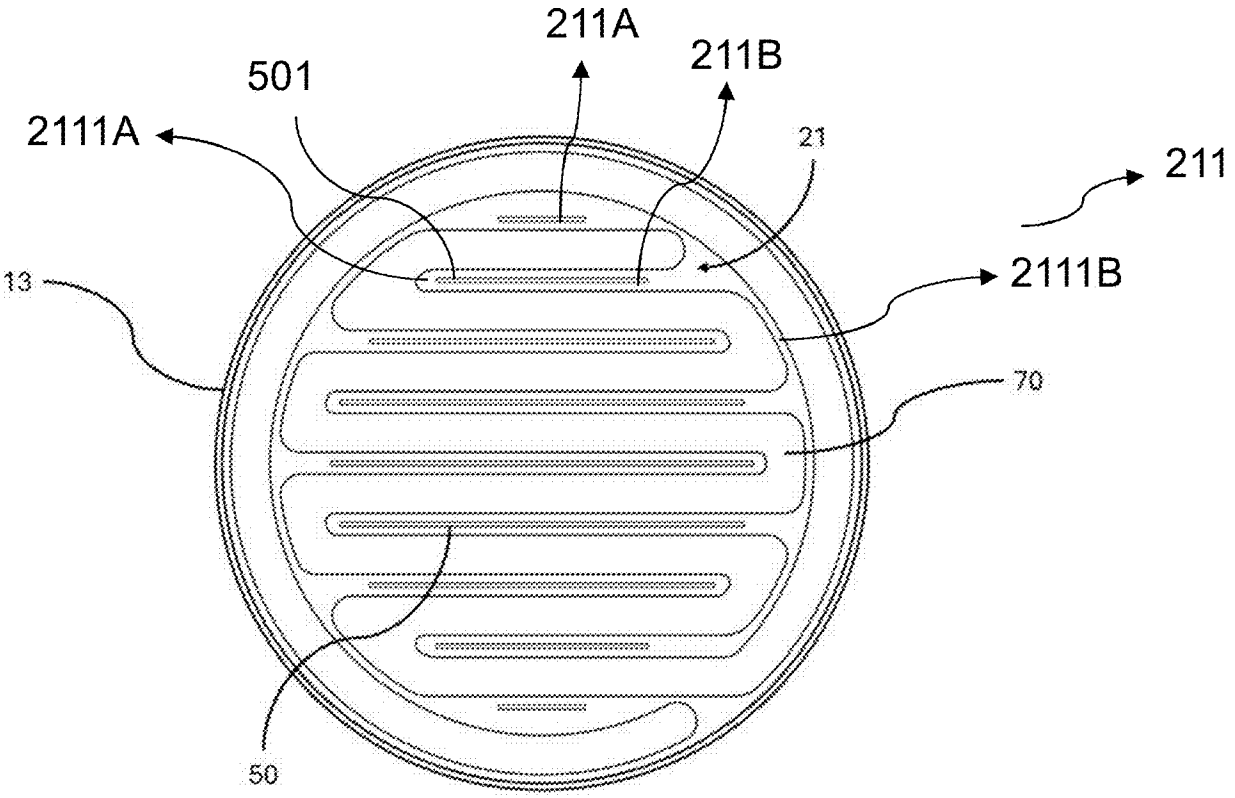
FIG. 4 is a top cross-sectional view of the inflatable mattress structure with overlapping independent air chambers according to another aspect of the embodiment.

Referring to FIG. 1 and FIG. 3, the shape and size of the cover 10 may not be specifically limited, and may be configured in various dimensions and geometries, including but not limited to quadrilateral, circular, triangular, star-shaped, or polygonal forms. In some embodiments, the cover 10 may be formed as a cylinder or a quadrilateral prism to define an enclosed air chamber 20.

As shown in FIG. 1 and FIG. 3, the enclosed air chamber 20 of the inflatable mattress structure 100 may be a hollow region defined and enclosed by the cover 10. The material and configuration of the cover 10 may be strong, breathable, or have a comfortable texture, thereby preventing damage and allowing air or water vapor molecules within the enclosed air chamber 20 to readily circulate and exchange with the external environment through the cover 10.

Continuing to FIG. 1 to FIG. 6, the inflatable mattress structure 100 may comprise at least one middle divider 30 arranged inside the enclosed air chamber 20, wherein each of the middle dividers 30 may comprise a peripheral middle divider edge 301 securely and entirely affixed to the middle cover portion 13. The peripheral middle divider edge 301 may be a periphery of the middle cover portion 13. In such a way, the enclosed air chamber 20 may be divided to form a top enclosed air chamber 21 and a bottom enclosed air chamber 22, wherein the top enclosed air chamber 21 and the bottom enclosed air chamber 22 are independent and isolated chambers without communicating with each other. It should be noted that, in some embodiments, the top enclosed air chamber 21 may be overlapped with the bottom enclosed air chamber 22.

In some embodiments, more than one middle divider 30 may be employed, or a thicker middle divider 30 may be used to enhance the separation and supporting strength between the top enclosed air chamber 21 and the bottom enclosed air chamber 22. In another embodiment, two independent inflatable mattresses structure 100 may be stacked and tightly affixed together to achieve a similar structure that provides the arrangement of two middle dividers 30.

Referring back to FIGS. 1, 2, and 5, in some embodiments, the inflatable mattress structure 100 may comprise zippers 40 arranged on the middle cover portion 13. It should be noted that, the middle cover portion 13 may be divided into a first middle cover portion 133 and a second middle cover portion 134 by the middle divider 30, wherein the top enclosed air chamber 21 may be formed within the top cover portion 11, the first middle cover portion 133, and the middle divider 30, and in other words, the bottom enclosed air chamber 22 may be formed within the bottom cover portion 12, the second middle cover portion 134, and the middle divider 30. In some embodiments, the zippers 40 may comprise a first zipper 41 arranged on and surrounding the first middle cover portion 133 and a second zipper 42 arranged on and surrounding the second middle cover portion 134. In such a situation, the operation of the first zipper 41 may allow the top enclosed air chamber 21 to be opened or closed. The operation of the second zipper 42 may allow the bottom enclosed air chamber 22 to be opened or closed. Each of the zippers 40 (including the first zipper 41 and the second zipper 42) may be configured as either a single-slider zipper or a double-slider zipper, and may further be implemented as either a one-way zipper or a two-way zipper.

Figure 5:
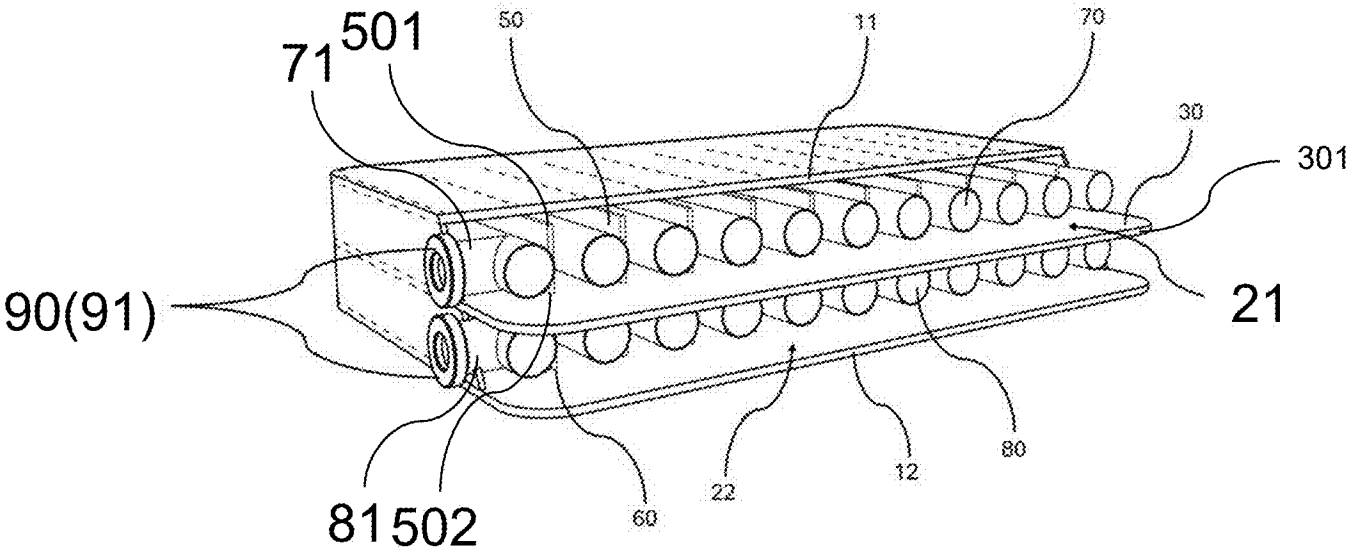
FIG. 5 is a side cross-sectional view of the inflatable mattress structure with overlapping independent air chambers according to an aspect of the embodiment.

Referring to further details in FIG. 1 and FIG. 5, the inflatable mattress structure 100 may further comprise a first valve 90 and a second valve 91, wherein the first valve 90 may be arranged on the first middle cover portion 133, and the second valve 91 may be arranged on the second middle cover portion 134. Since the enclosed air chamber 20 is separated as two isolated and independent top enclosed air chamber 21 and bottom enclosed air chamber 22, the first valve 90 may be configured to independently inflate, deflate, or seal the top enclosed air chamber 21, and on the other hand, the second valve 91 may be configured to independently inflate, deflate, or seal the bottom enclosed air chamber 22, and in such a way, the inflation level of the top enclosed air chamber 21 and the inflation level of the bottom enclosed air chamber 22 may be controlled separately to separately adjust of the softness or firmness of the top enclosed air chamber 21 and the bottom enclosed air chamber 22, thereby achieving the unique effects of significantly reducing sway and enhancing comfort.

Referring to FIG. 2 to FIG. 8, the inflatable mattress structure 100 may comprise at least one first divider 50 arranged inside the top enclosed air chamber 21, wherein the first divider 50 may be arranged between the top cover portion 11 and the middle divider 30, wherein the first divider 50 may be in the form of a flat strip, wherein each of the first divider 50 may comprise a first top divider end 501 and a first bottom divider end 502 formed on the opposite side of the first top divider end 501, wherein the first top divider 501 may be affixed to the top cover portion 11 and the first bottom divider end 502 may be affixed to the middle divider 30, and in such a way, the top enclosed air chamber 21 may be divided into at least one sub-top enclosed air chamber 211 by the first divider 50.

It should be noted that, in some embodiments, while the number of the first divider 50 is "N", the top enclosed air chamber 21 may be divided into "N+1" sub-top enclosed air chambers 211. For example, while the number of the first divider 50 is one, the top enclosed air chamber 21 may be divided into two sub-top enclosed air chambers 211 (a first sub-top enclosed air chamber 211A and a second sub-top enclosed air chamber 211B). For another example, while the number of the first divider 50 is two, the top enclosed air chamber 21 may be divided into three sub-top enclosed air chambers 21 (a first sub-top enclosed air chamber 211A, a second sub-top enclosed air chamber 211B, and a third sub-top enclosed air chamber 211C). For still another example, while the number of the first divider 50 is three, the top enclosed air chamber 21 may be divided into four sub-top enclosed air chambers 211 (a first sub-top enclosed air chamber 211A, a second sub-top enclosed air chamber 211B, a third sub-top enclosed air chamber 211C, and a fourth sub-top enclosed air chamber 211D). It should be noted that each of the sub-top enclosed chambers 211 may be arranged adjacent to each other, wherein each one of the sub-top enclosed chambers 211 may be communicated with another one of the sub-top enclosed chambers 211.

In some embodiments, the top enclosed air chamber 21 may comprise at least one first top opening 2111A communicated between the first sub-top enclosed air chamber 211A and the second sub-top enclosed air chamber 211B, at least one second top opening 2111B communicated between the second sub-top enclosed air chamber 211B and the third sub-top enclosed air chamber 211C, and at least one third top opening 2111C communicated between the third sub-top enclosed air chamber 211C and the fourth sub-top enclosed chambers 211D.

It should be noted that, in some embodiments, each of the first dividers 50 does not contact the others. In some embodiments, each of the first dividers 50 may be arranged in parallel with each other. In some embodiments, each of the first dividers 50 may be arranged at an equal distance, and in such a way, the distance between any two of the first dividers 50 is the same, and in such a way, the distance between adjacent first dividers 50 is the same. In still another embodiment, each of the first dividers 50 is identical. In still another embodiments, the middle cover portion 13 may comprise a front middle cover portion 135, a rear middle cover portion 136 arranged on the opposite side of the front middle cover portion 135, a left middle cover portion 137, and a right middle cover portion 138 arranged on the opposite of the left middle cover portion 137, wherein the front middle cover portion 135 may be integrally extended between right middle cover portion 138 and the left middle cover portion 137, and the rear middle cover portion 136 may be integrally extended between left middle cover portion 137 and the right middle cover portion 138, and in such a way, the middle cover portion 13 may be formed by the front middle cover portion 135, the rear middle cover portion 136, the left middle cover portion 137, and the right middle cover portion 138. It should be noted that, in some embodiments, each of the first dividers 50 may be arranged in parallel with respect to the front middle cover portion 135 and the rear middle cover portion 136. In other words, in some embodiments, each of the first dividers 50 may be parallel to the left middle cover portion 137 and the right middle cover portion 138.

Depending on the characteristics of the selected material, each of the first dividers 50 may be fixedly attached to the top cover portion 11 and the middle divider 30 by high-frequency welding, stitching, or adhesion methods.

Figure 7:
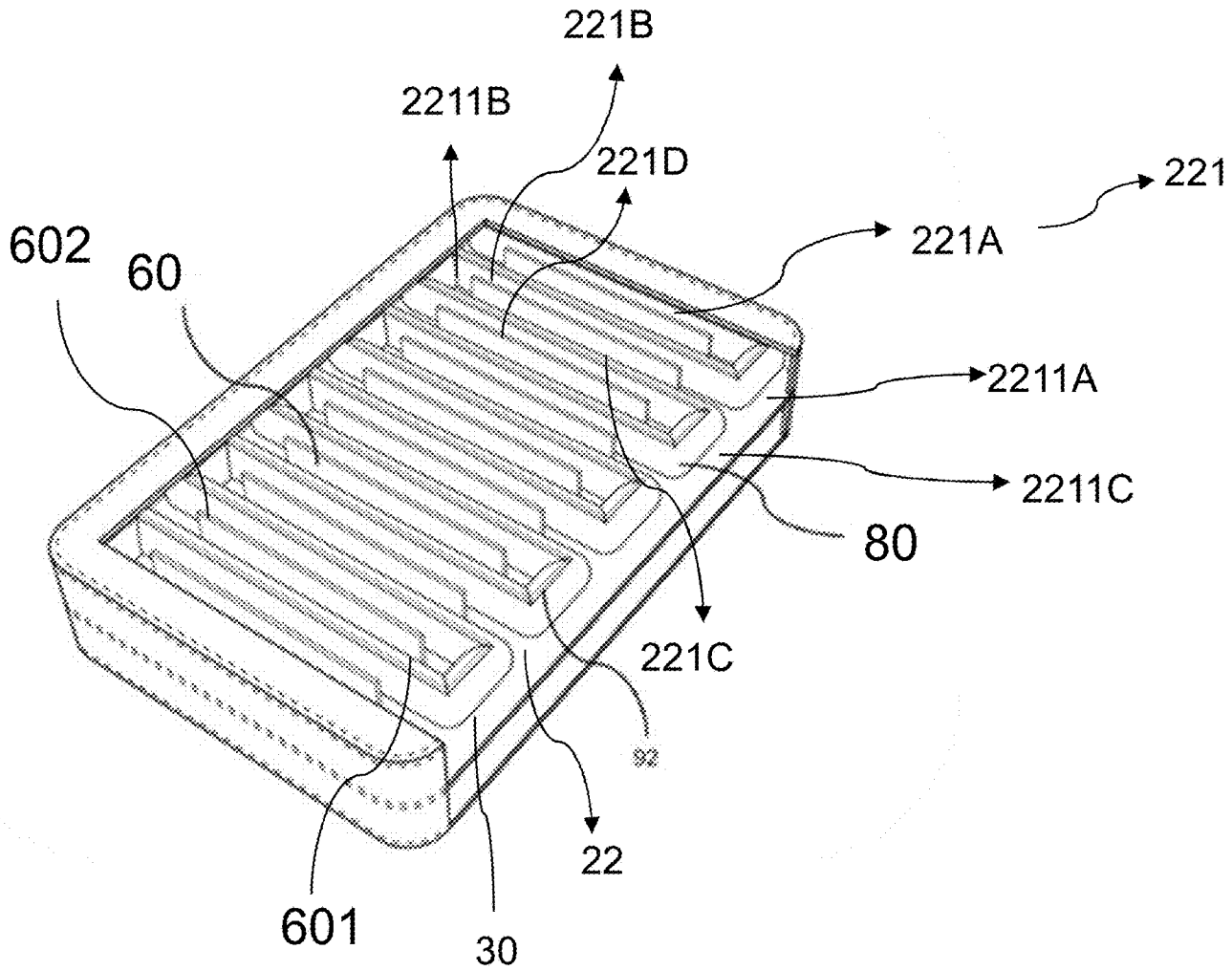
FIG. 7 is a bottom cross-sectional view of the inflatable mattress structure with overlapping independent air chambers according to an aspect of the embodiment.

As shown in further details in FIG. 2 and FIG. 7, the inflatable mattress structure 100 may comprise at least one second divider 60 arranged inside the bottom enclosed air chamber 22, wherein the second divider 60 may be arranged between the bottom cover portion 12 and the middle divider 30, wherein the second divider 60 may be in the form of a flat strip, wherein each of the second divider 60 may comprise a second top divider end 601 and a second bottom divider end 602 formed on the opposite side of the second top divider end 601, wherein the second top divider end 601 may be affixed to the middle divider 30, and the second bottom divider end 602 may be affixed to the bottom cover portion 12, and in such a way, the bottom enclosed air chamber 22 may be divided into at least one sub-bottom enclosed air chamber 221 by the second divider 60.

It should be noted that, in some embodiments, while the number of the second divider 60 is "N", the bottom enclosed air chamber 22 may be divided into "N+1" sub-bottom enclosed air chambers 221. For example, while the number of the second divider 60 is one, the bottom enclosed air chamber 22 may be divided into two sub-bottom enclosed air chambers 221 (a first sub-bottom enclosed air chamber 221A and a second sub-bottom enclosed air chamber 221B). For another example, while the number of the second divider 60 is two, the bottom enclosed air chamber 22 may be divided into three sub-bottom enclosed air chambers 221 (the first sub-bottom enclosed air chamber 221A, the second sub-bottom enclosed air chamber 221B, and a third sub-bottom enclosed air chamber 221C). For still another example, while the number of the second divider 60 is three, the bottom enclosed air chamber 22 may be divided into four sub-bottom enclosed air chambers 221 (the first sub-bottom enclosed air chamber 221A, the second sub-bottom enclosed air chamber 221B, the third sub-bottom enclosed air chamber 221C, and the fourth sub-bottom enclosed air chamber 221D). It should be noted that each of the sub-bottom enclosed chambers 221 may be arranged adjacent to each other, wherein each one of the sub-bottom enclosed chambers 221 may be communicated with another one of the sub-bottom enclosed chambers 221.

In some embodiments, the bottom enclosed air chamber 22 may comprise at least one first bottom opening 2211A communicated between the first sub-bottom enclosed air chamber 221A and the second sub-bottom enclosed air chamber 221B, at least one second bottom opening 2211B communicated between the second sub-bottom enclosed air chamber 221B and the third sub-bottom enclosed air chamber 221C, and at least one third bottom opening 2211C communicated between the third sub-bottom enclosed air chamber 221C and the fourth sub-bottom enclosed chambers 221D.

It should be noted that, in some embodiments, each of the second dividers 60 does not contact the others. In some embodiments, each of the second dividers 60 may be arranged in parallel with each other. In some embodiments, each of the second dividers 60 may be arranged at an equal distance, and in such a way, the distance between any of the two second dividers 60 is the same, and in such a way, the distance between adjacent second dividers 60 is the same. In still another embodiment, each of the second dividers 60 is identical. It should be noted that, in some embodiments, each of the second dividers 60 may be arranged in parallel with respect to the front middle cover portion 135 and the rear middle cover portion 136. In other words, in some embodiments, each of the second dividers 60 may be parallel to the left middle cover portion 137 and the right middle cover portion 138.

Depending on the characteristics of the selected material, each of the second dividers 60 may be fixedly attached to the bottom cover portion 12 and the middle divider 30 by high-frequency welding, stitching, or adhesion methods.

Referring to FIGS. 3, 4, and 7-9, the inflatable mattress structure 100 may further comprise a first inflatable inner tube 70 and a second inflatable inner tube 80. The first inflatable inner tube 70 may be removably inserted, sequentially passed through, and is disposed within each sub-top enclosed air chamber 211 of the top enclosed air chamber 21, wherein the second inflatable inner tube 80 may be removably inserted, sequentially passed through, and is disposed within each sub-bottom enclosed air chamber 221 of the bottom enclosed air chamber 22.

In some embodiments, the first inflatable inner tube 70 may be passed sequentially through the first sub-top enclosed air chamber 211A, one of the at least one first top opening 2111A, the second sub-top enclosed air chamber 211B, one of the at least one second top opening 2111B, the third sub-top enclosed air chamber 211C, one of the at least one third top opening 2111C, and the fourth sub-top enclosed chambers 211D. The first inflatable inner tube 70 may be passed through each of the sub-top enclosed air chambers 211 one by one.

In some embodiments, the second inflatable inner tube 80 may be passed sequentially through the first sub-bottom enclosed air chamber 221A, one of the at least one second top opening 2211A, the second sub-bottom enclosed air chamber 221B, one of the at least one second bottom opening 2211B, the third sub-bottom enclosed air chamber 221C, one of the at least one third bottom opening 2211C, and the fourth sub-bottom enclosed chambers 221D. The second inflatable inner tube 80 may be passed through each of the sub-bottom enclosed air chambers 221 one by one.

The arrangement of the first inflatable inner tube 70 and the second inflatable inner tube 80 allows the inflation volume of the first inflatable inner tube 70 and the second inflatable inner tube 80 to be adjusted independently according to usage requirements, thereby further enhancing the effect of adjusting softness and hardness and reducing shaking.

In some embodiments, the diameter of the first inflatable inner tube 70 may be set to be the same as that of the second inflatable inner tube 80. The use of the first inflatable inner tube 70 and the second inflatable inner tube 80, both having the same diameter, may make the inflatable mattress structure 100 with overlapping independent air chambers less prone to deformation, provide a more aesthetically pleasing overall appearance, and facilitate easier production and manufacturing.

Figure 6:
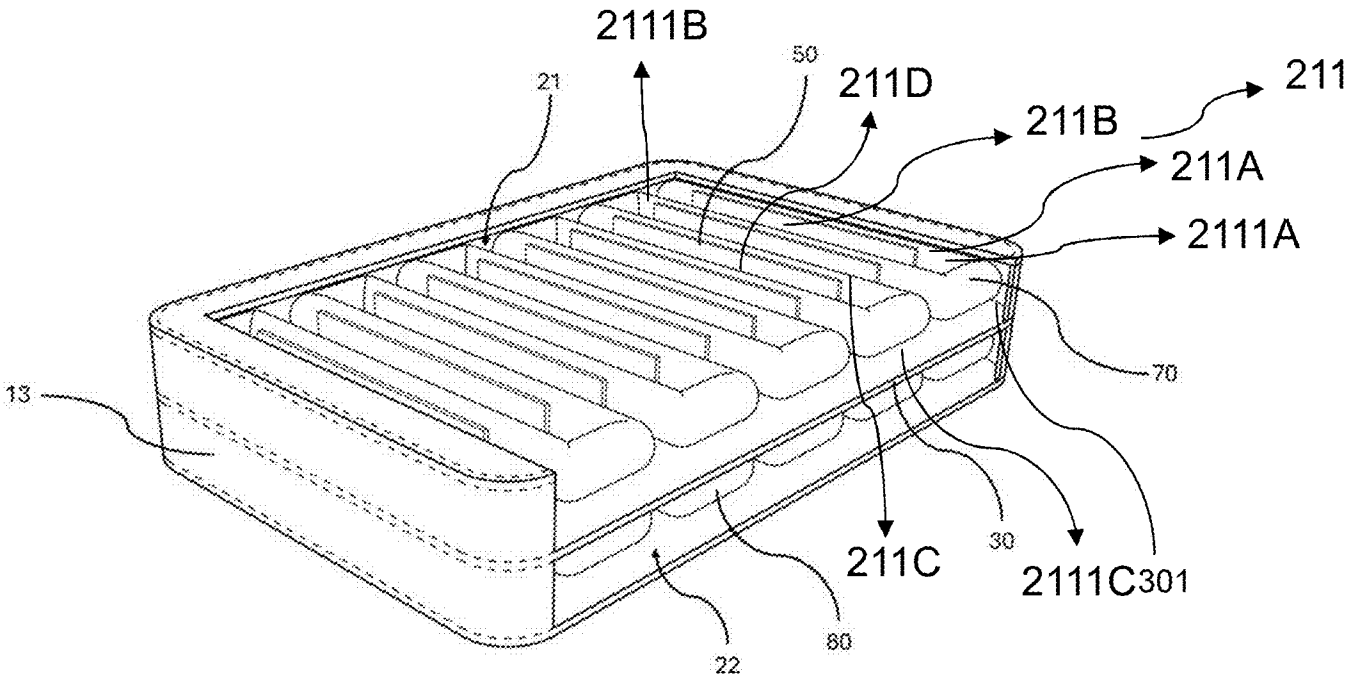
FIG. 6 is a top cross-sectional view of the inflatable mattress structure with overlapping independent air chambers according to an aspect of the embodiment.

Referring to FIGS. 1, 5 and 6, the first inflatable inner tube 70 may be removably inserted sequentially through and disposed within each sub-top enclosed air chamber 211 of the top enclosed air chamber 21 one by one, wherein the second inflatable inner tube 80 may be removably inserted sequentially through and disposed within each sub-bottom enclosed air chamber 221 one by one of the bottom enclosed air chamber 22. The first inflatable inner tube 70 may comprise a first end 71 that is connected and communicated with the first valve 90, which is configured to be opened or closed. On the other hand, the second inflatable inner tube 80 may comprise a second end 81 that is connected and communicated with the second valve 91, which is configured to be opened or closed. The first valve 90 and the second valve 91 may be arranged on the middle cover portion 13 and configured to inflate, deflate, or seal the first inflatable inner tube 70 and the second inflatable inner tube 80, respectively.

Referring back to FIG. 1, the first zipper 41 arranged on the first middle cover portion 133 and the second zipper 42 arranged on the second middle cover portion 134 may be operated to be independently opened or closed, to organize, clean, or maintain the first inflatable inner tube 70 and the second inflatable inner tube 80 independently.

It should be noted that the first zipper 41 and the second zipper 42 may be arranged on the middle cover portion 13 and surround the middle cover portion 13 by stitching, high-frequency welding, or other feasible methods, depending on the material used for the cover 10. The first zipper 41 may be disposed corresponding to the position of the top enclosed air chamber 21, and the second zipper 42 may be disposed corresponding to the position of the bottom enclosed air chamber 22.

As shown in FIG. 5, the first valve 90 and the second valve 91 may be arranged on the middle cover portion 13 and configured to inflate, deflate, or seal the top enclosed air chamber 21 and the bottom enclosed air chamber 22, respectively. In some embodiments, the top enclosed air chamber 21 and the bottom enclosed air chamber 22 may comprise respectively with the first inflatable inner tube 70 and the second inflatable inner tube 80, wherein the first valve 90 and the second valve 91 may be fixed to and extended through the middle cover portion 13, and are detachably and respectively connected and fixed to the first inflatable inner tube 70 and the second inflatable inner tube 80. In such a way, the first inflatable inner tube 70 and the second inflatable inner tube 80 may be inflated, deflated, or sealed independently, thereby respectively controlling the inflation degree of the first inflatable inner tube 70 and the second inflatable inner tube 80, to control the softness and hardness of the top enclosed air chamber 21 and the bottom enclosed air chamber 22, achieving the unique effect of greatly reducing shaking and increasing comfort of the entire inflatable mattress structure 100. In some embodiments, the first zipper 41 and the second zipper 42 may be independently and conveniently opened or closed, respectively, to allow installation or removal of the first inflatable inner tube 70 or the second inflatable inner tube 80.

Figure 8:
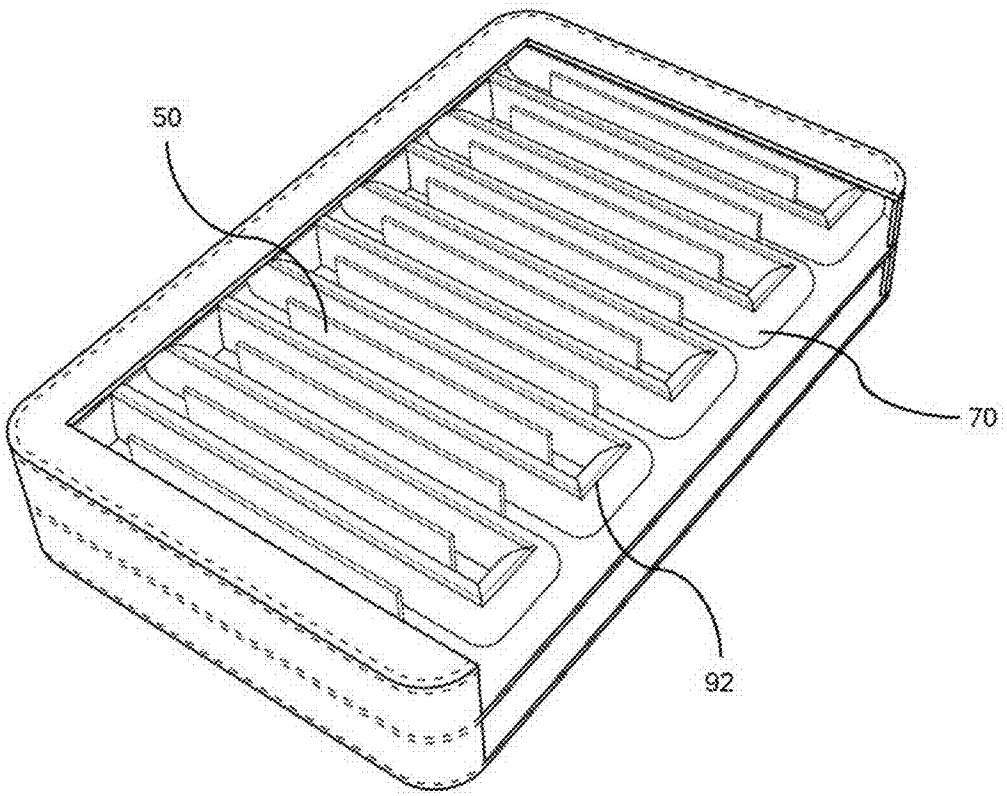
FIG. 8 is another top cross-sectional view of the inflatable mattress structure with overlapping independent air chambers according to an aspect of the embodiment.
Figure 9:
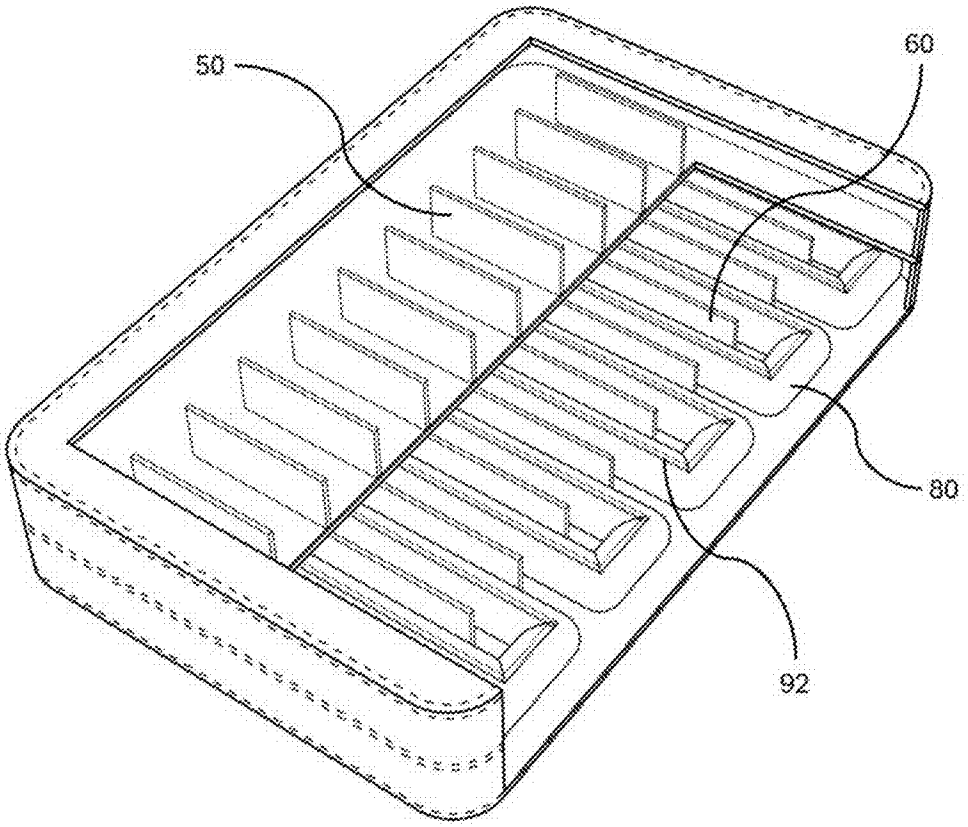
FIG. 9 is another bottom cross-sectional view of the inflatable mattress structure with overlapping independent air chambers according to an aspect of the embodiment.

Referring to FIGS. 7-9, inner walls of the first inflatable inner tube 70 and the second inflatable inner tube 80 may comprise at least one three-dimensional member 92. The size of the three-dimensional member 92 may be smaller than the diameter of the first inflatable inner tube 70 and smaller than the diameter of the second inflatable inner tube 80.

In some embodiments, the first inflatable inner tube 70 and the second inflatable inner tube 80 may be inflated to form a tough cylindrical body, or deflated to become a flat shape made of an easily bendable and stowable sealed member. The cover 10 may be made of breathable, flexible, and comfortable materials.

The three-dimensional member 92 may be configured to provide a unique improvement effect in a preferred embodiment: throughout the entire process of inflating or deflating, the first inflatable inner tube 70 and/or the second inflatable inner tube 80 may be inflated or deflated without obstruction. The first inflatable inner tube 70 and/or the second inflatable inner tube 80 may not become partially flattened during inflation or deflation and get caught by the first dividers 50 or the second dividers 60, which would otherwise cause deflation difficulties.

In some embodiments, the three-dimensional member 92 may be disposed on the inner walls of the first inflatable inner tube 70 and/or the second inflatable inner tube 80 and extend from one end to the other. In other words, the three-dimensional members 92 are hidden inside the first inflatable inner tube 70 and the second inflatable inner tube 80, and in such a way, the three-dimensional members 92 don't expose outside.

The thickness of the three-dimensional member 92 may be approximately 3 mm. However, the length of the three-dimensional member 92 may not extend throughout the entire first inflatable inner tube 70 or the entire second inflatable inner tube 80, and in other words, the three-dimensional member 92 may pass through each of the first dividers 50 or each of the second dividers 60.

Referring to FIGS. 1-9, the inflatable mattress structure 100 with overlapping independent air chambers may not only allow for simple setup and storage, but also prevent the entire mattress from becoming arcuate after inflation. It features overlapping, layered, independent air chambers, with the upper and lower layers capable of being inflated separately to adjust their softness and hardness independently. The layered, independent air chamber structure effectively and significantly reduces shaking, allowing for easy rinsing and air-drying for reuse, thereby preventing dirt accumulation and infection. The first dividers, 50, and the second dividers 60 may cause the surface to form wave-like patterns when inflated, enhancing breathability and heat dissipation during use. The cover can be selected from various appearances or materials and quickly replaced according to application needs or preference. These special effects make it suitable for various applications, including automotive, household, and hospital settings, as well as serving as a seat cushion, meeting a wide range of application requirements. When the first inflatable inner tube 70 and the second inflatable inner tube 80 are respectively provided in the top and bottom enclosed air chambers 21, 22, the effect of independently adjusting the softness and hardness of the upper and lower mattress layers (top and bottom enclosed air chambers 21, 22) and reducing shaking is further enhanced. Furthermore, even if the cover 10 is damaged, the inflatable mattress structure can still be fully functional and continue to be used.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

Thus, specific embodiments and applications of the inflatable mattress structure with overlapping independent air chambers have been disclosed. It should be apparent, however, to those skilled in the art that many more modifications besides those already described are possible without departing from the disclosed concepts herein. The disclosed embodiments, therefore, are not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be substituted, and also what essentially incorporates the essential idea of the embodiments. In addition, where the specification and claims refer to at least one of something selected from the group consisting of A, B, C, . . . , and N, the text should be interpreted as requiring at least one element from the group, which includes N, not A plus N, or B plus N, etc.

The words used in this specification to describe the various embodiments are to be understood not only in the sense of their commonly defined meanings, but also to include, by special definition in this specification, structure, material, or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense, it is therefore contemplated that an equivalent substitution of two or more elements may be made for any one of the elements in the claims below, or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. An inflatable mattress structure having overlapping independent air chambers, comprising: a cover made of a flexible material and comprising a top cover portion, a bottom cover portion, and a middle cover portion having two opposite edges affixed with the top cover portion and the bottom cover portion, respectively; at least one middle divider arranged inside the cover and having a periphery securely and entirely affixed to the middle cover portion; an enclosed air chamber formed by the cover and divided by the middle divider to form a top enclosed air chamber and a bottom enclosed air chamber; wherein the bottom enclosed air chamber is overlappingly, isolatedly, and independently arranged on the top enclosed air chamber without the capability of communicating with the top enclosed air chamber; at least one first divider disposed inside the top enclosed air chamber and having a first top divider end tightly affixed to the top cover portion and a first bottom divider end tightly affixed to the middle divider to divide the top enclosed air chamber into at least two sub-top enclosed air chambers; at least one second divider disposed inside the bottom enclosed air chamber and having a second top divider end tightly affixed to the middle divider and a second bottom divider end tightly affixed to the bottom cover portion to divide the bottom enclosed air chamber into at least two sub-bottom enclosed air chambers; wherein one of the at least two sub-top enclosed air chambers is arranged adjacent to another one of the at least two sub-top enclosed air chambers and is communicated with another one of the sub-top enclosed air chambers; wherein one of the at least two sub-bottom enclosed air chambers is arranged adjacent to another one of the at least two sub-bottom enclosed air chambers and is communicated with another one of the sub-bottom enclosed air chambers, a first inflatable inner tube and a second inflatable inner tube, wherein the first inflatable inner tube is removably inserted and sequentially passed through the sub-top enclosed air chambers, and the second inflatable inner tube is removably inserted and sequentially passed through the sub-bottom enclosed air chambers.

2. The inflatable mattress structure according to claim 1, wherein each of the at least one first divider does not contact with each other, and each of the at least one second divider does not contact with each other.

3. The inflatable mattress structure according to claim 1, wherein each of the at least one first divider does not contact with each other, and each of the at least one second divider does not contact with each other.

4. The inflatable mattress structure according to claim 1, wherein two opposite edges of the middle cover portion are affixed with the top cover portion and the bottom cover portion by a method that is the same as the method for affixing the middle divider with the middle cover portion.

5. The inflatable mattress structure according to claim 4, wherein the method is selected from a group consisting of a high-frequency welding method and a stitching method.

6. The inflatable mattress structure according to claim 1, wherein two opposite edges of the middle cover portion are affixed with the top cover portion and the bottom cover portion by a method that is the same as the method for affixing the middle divider with the middle cover portion.

7. The inflatable mattress structure according to claim 1, further comprising a first valve and a second valve arranged on a front middle cover portion of the middle cover portion, wherein the first valve is configured to inflate, deflate, or seal only the top enclosed air chamber, and the second valve is configured to inflate, deflate, or seal only the bottom enclosed air chamber.

8. The inflatable mattress structure according to claim 1, wherein the first inflatable inner tube is connected with a first valve which is arranged and passed through the middle cover portion, wherein the first valve is configured to only inflate, deflate, or seal the top enclosed air chamber.

9. The inflatable mattress structure according to claim 8, wherein the second inflatable inner tube is connected with a second valve which is arranged and passed through the middle cover portion, wherein the second valve is configured to only inflate, deflate, or seal the bottom enclosed air chamber.

10. The inflatable mattress structure according to claim 1, wherein the middle cover portion is divided into a first middle cover portion and a second middle cover portion by the middle divider, wherein the top enclosed air chamber is formed only by the top cover portion, the first middle cover portion, and the middle divider, and the bottom enclosed air chamber is formed only by the bottom cover portion, the second middle cover portion, and the middle divider.

11. The inflatable mattress structure according to claim 10, further comprising a first valve arranged on the first middle cover portion and a second valve arranged on the second middle cover portion.

12. The inflatable mattress structure according to claim 10, further comprising a first zipper arranged on and surrounding the first middle cover portion and a second zipper arranged on and surrounding the second middle cover portion.

13. The inflatable mattress structure according to claim 1, wherein a diameter of the second inflatable inner tube is equal to a diameter of the first inflatable inner tube.

14. The inflatable mattress structure according to claim 13, further comprising at least one three-dimensional member arranged on an inner wall of the first inflatable inner tube and an inner wall of the second inflatable inner tube.

15. The inflatable mattress structure according to claim 1, further comprising at least one three-dimensional member arranged on an inner wall of the first inflatable inner tube and an inner wall of the second inflatable inner tube.

16. The inflatable mattress structure according to claim 1, further comprising a first inflatable inner tube, a second inflatable inner tube, and at least one three-dimensional member, wherein the three-dimensional members are disposed on an inner wall of the first inflatable inner tube and on an inner wall of the second inflatable inner tube, wherein the first inflatable inner tube is removably inserted and sequentially passed through each of the sub-top enclosed air chambers one by one, and the second inflatable inner tube is removably inserted and sequentially passed through each of the sub-bottom enclosed air chambers one by one.

17. The inflatable mattress structure according to claim 1, wherein the first inflatable inner tube and the second inflatable inner tube are inflatable independently of each other.

18. The inflatable mattress structure according to claim 1, further comprising a first zipper arranged on and surrounding the top enclosed air chamber and a second zipper arranged on and surrounding the bottom enclosed air chamber.

19. The inflatable mattress structure according to claim 1, wherein the middle divider is parallelly arranged with the top cover portion and the bottom cover portion.

* * * * *